United States Patent [19]

Higuma et al.

[11] Patent Number: 5,059,983

[45] Date of Patent: Oct. 22, 1991

[54] RECORDING MEDIUM AND RECORDING METHOD THEREFOR

[75] Inventors: Masahiko Higuma, Tokyo; Takahiro Mori; Hiroshi Sato, both of Yokohama, all of Japan

[73] Assignee: Canon Kabushiki Kaisha, Tokyo, Japan

[21] Appl. No.: 393,235

[22] Filed: Aug. 14, 1989

[30] Foreign Application Priority Data

Aug. 19, 1988 [JP] Japan ..... 63-206134

[51] Int. Cl.[5] ..... B41M 5/00

[52] U.S. Cl. ..... 346/1.1; 346/135.1; 427/256; 428/195; 428/210; 428/914

[58] Field of Search ..... 346/135.1, 1.1; 428/195, 304.4, 318.4, 913, 210, 914; 427/256

[56] References Cited

U.S. PATENT DOCUMENTS 4,785,313 11/1988 Higuma et al. ..... 346/1.1
4,832,984 5/1989 Hasegawa et al. ..... 346/1.1
4,954,395 9/1990 Hasegawa et al. ..... 346/135.1

FOREIGN PATENT DOCUMENTS 0227245 7/1987 European Pat. Off. ..... 428/195
63-139964 6/1988 Japan ..... 428/195

OTHER PUBLICATIONS

Patent Abstracts of Japan, vol. 12, No. 398 (C-538 ), (3245) with respect to Japanese Patent Document No. 63-139964, dated Jun. 11, 1988, Oct. 21, 1988.

*Primary Examiner*—Pamela R. Schwartz
*Attorney, Agent, or Firm*—Fitzpatrick, Cella, Harper & Scinto

[57] ABSTRACT

A recording medium having an ink retaining layer and an ink transporting layer provided on a substrate of a resin film or a glass plate, said ink transporting layer comprising combinedly a surfactant and an acetylene glycol and/or an acetylene alcohol is provided.

32 Claims, 1 Drawing Sheet

RECORDING MEDIUM AND RECORDING METHOD THEREFOR

BACKGROUND OF THE INVENTION

1. Field of the Invention

The present invention relates to a recording medium suitable for color ink-jet recording, and particularly to a recording medium suitable for ink jet recording in full color applying a large amount of ink per unit area in high recording density of 300 dpi or more without causing a black stripe, with excellent characteristics in ink absorption, recording image sharpness and image resolution.

2. Related Background Art

Ink jet recording is attracting a great deal of attention as a recording method capable of high speed printing and multicolor printing without generating noises.

Various recording media are disclosed for the ink jet recording.

Japanese Patent Laid-open Publication No. 55-144172 (1980) describes a sheet comprising a porous ink absorbing layer provided on a substrate.

With such sheets, ink absorbency has been improved, but disadvantages still remain such that sharp and glossy images with high optical density cannot be obtained because of the porous nature of the ink absorbing layer.

Conventional recording media are constructed such that largest amount of the recording agent applied remains on the surface of the ink absorbing layer for observing the recorded image from the recorded side, resulting in disadvantages in durability or storability such as water resistance, abrasion resistance, etc.

To solve such problems, Japanese Patent Laid-open Publication No. 58-136480 (1983) discloses a recording medium comprising at least one layer of an ink receiving layer mainly composed of a pigment provided on a light-transmissive supporter for observing the image from the side of the supporter.

An image formed on such a recording medium has satisfactory characteristics in water-resistance, gloss, etc. at the image observing face (the supporter side), but has a disadvantage of low optical density of the image observed from the supporter side because of the hiding of the dye of the applied ink by the pigment particles, thus no high-quality of the image being given.

Further, when a color image is recorded on such a recording medium, the ink having reached to the interface of the supporter stays there and spreads along the supporter interface, which causes a disadvantage of low dissolution of the image.

To offset such disadvantages, U.S. Pat. No. 4,785,313 discloses a recording medium comprising a porous ink transporting layer containing a surfactant and a non-porous ink retaining layer, both layers being provided on a supporter.

The use of the above-mentioned recording media offsets the disadvantages, and gives a high optical density of the image observed from the supporter side, and a high quality of the image.

Even with such a recording media, however, a problem is still involved in that a black stripe may be formed, lowering the image quality when the recording is conducted with a larger amount of ink per unit area with a high density of 300 dpi or more.

SUMMARY OF THE INVENTION

The object of the present invention is to solve the problems of the prior art and to provide a recording medium that is excellent in ink absorption, recording image sharpness and image resolution without causing a black stripe in high-density full-color recording even with application of a larger amount of ink.

According to an aspect of the present invention, there is provided a recording medium having an ink-retaining layer and an ink-transporting layer, said ink transporting layer comprising combinedly a surfactant and an acetylene glycol and/or an acetylene alcohol.

DETAILED DESCRIPTION OF THE PREFERRED EMBODIMENTS

Figure 1:
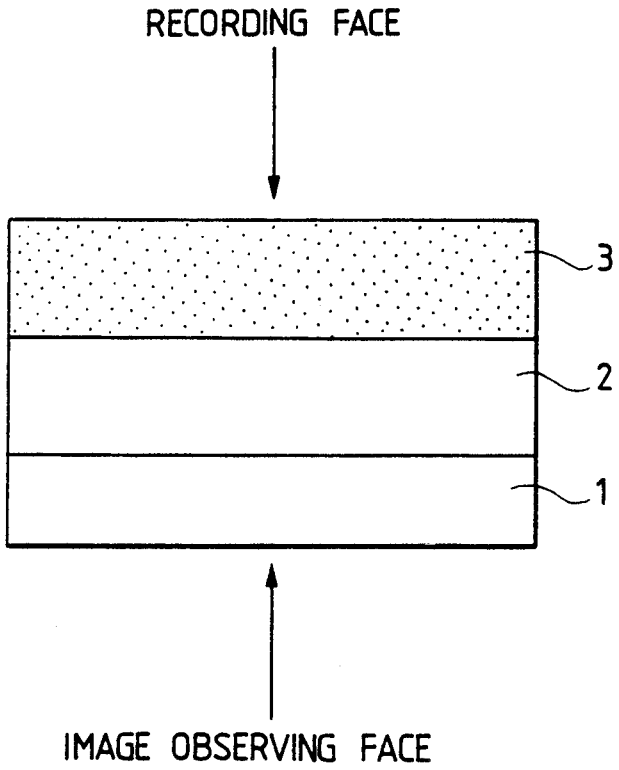
FIG. 1 is a schematic sectional view of the recording medium of the present invention. In the figure, the numeral 1 denotes a substrate; 2 an ink retaining layer; and 3 an ink transporting layer.

The term "black stripe" in the present invention means a darker portion appearing in printing with an ink jet printer which has a recording head having a plurality of nozzles provided thereon perpendicularly to the scanning direction of the carriage, and which conducts recording by movement of the carriage relative to the recording medium. The darker portion is caused by overlapping of the lowermost printed portion of the preceeding printing and the uppermost printed portion of the subsequent printing in the recording medium delivery direction.

The present invention is described below in detail.

The recording medium of the present invention has a characteristic basically that the optical density (O.D.) of the image at the image observing face (namely the substrate side) is higher than the O.D. of the image at the recording face where ink is applied (namely the ink transporting side).

The feature of the present invention is such basic characteristic of the recording medium and inclusion of a surfactant and an acetylene glycol and/or an acetylene alcohol combinedly in the ink transporting layer.

The present invention is described by referring to preferred embodiments.

The recording medium of the present invention is constituted of a substrate serving as a supporter, an ink retaining layer provided thereon for absorbing and retaining ink or a recording agent, and an ink transporting layer provided further thereon for receiving ink directly and transporting the ink.

The ink transporting layer of the present invention is capable of transporting a liquid and serves to absorb rapidly ink attached to the surface thereof and allow it to pass through.

This ink transporting layer is required to have a high affinity to the liquid medium of the ink, and contrarily to have a low affinity to the recording agent (namely a color-forming substance such as a dye or a pigment).

Accordingly the ink transporting layer shall be constituted of a material having characteristics of wettability, permeability, diffusibility, etc. toward the ink medium but not having characteristics of adsorption, dye fixing, reactivity, etc. toward the recording agent.

Further, a preferred embodiment for increasing the liquid-transporting ability of the ink transporting layer is the one having a porous structure of cracks or communicating holes in its interior. Such porous structure will simultaneously give light-diffusibility to the ink transporting layer.

An ink transporting layer satisfying the above characteristics is mainly constituted of a particulate material which does not fix the recording agent, and a binder therefor.

The particulate material employed in this invention may be either of primary particles comprising single particles or of porous particles comprising secondary particles formed from aggregation of the primary particles.

Among these particulate materials, particularly preferable are porous particles having a size of 1–30 μm, preferably 2–20 μm, more preferably 3–10 μm which are formed by aggregation of particles of a size of 0.01 to 2 μm, preferable 0.05 to 1 μm, more preferably 0.1 to 0.5 μm. These porous particles formed by secondary or tertiary aggregation will not easily disintegrate.

The porous material is preferably made of at least one of the materials of organic materials such as polystyrene, polymethacrylate, elastomers, ethylene-vinyl acetate copolymers, polyesters, polyacrylates polyvinyl ethers, polyamides, polyolefins, polysilicones, guanamine resins, polytetrafluoroethylenes, SBR, urea resins, urea-formalin resins, etc.; inorganic materials such as synthetic silica, clay, talc, diatomaceous earth, calcium carbonate, titanium oxide, zinc oxide, calcium sulfate, barium sulfate, zinc sulfide, satin white, aluminum silicate, lithopone, aluminum hydroxide, calcium silicate, etc.

The binders employed are those having a function of binding the particles mutually and/or the particles and the ink retaining layer, and are preferably non-dye-fixing similarly to the particles toward the recording agent.

The binder may be of any known material if it has the functions mentioned above: the examples are one or more of resins such as polyvinyl alcohols, acryl resins, styrene-acrylate copolymers, polyvinyl acetates, polyurethanes, ethylene-vinyl acetate copolymers, starch, polyvinyl-acetals, gelatin, casein, ionomers, gum arabia, carboxymethylcelluloses, polyvinylpyrrolidones, polyacrylamides, phenol resins, melamine resins, epoxy resins, styrene-butadiene rubbers, urea resins, alpha-olefin resins, chloroprene rubbers, and nitrile rubbers.

The mixing ratio of the porous particles and the binder depends on the kind and particle size of the porous particles, and is preferably in the range of 10/1 to 1/2, more preferably 5/1 to 1/1.

The surfactants employed in the present invention may be any of the cationic, anionic, amphoteric, and nonionic surfactants as described in Japanese Patent Laid-open Publication No. 62-280068 (1987). Examples of the surfactants are soap, N-alkylamino acid salts, alkylether carboxylic acid salts, acylated peptides, alkylsulfonic acid salts, alkylbenzene and alkylnaphthalene sulfonic acid salts, sulfosuccinic acid salt, α-olefinsufonic acid salts, N-acylsulfonic acid salts, sulfonated oils, alkylsulfonic acid salts, alkylethersulfonic acid salts, alkylallylethersulfonic acid salts, alkylamidesulfonic acid salts, alkylphosphoric acid salts, alkyletherphosphoric acid salts, alkylallyletherphosphoric acid salts, alkyl and alkylallylpolyoxyethylene ethers, alkylallylformaldehyde condensed polyoxyethylene ethers, blocked polymers having polyoxypropylene, polyoxyethylene polyoxypropylalkylethers, polyoxyethyleneether of glycelolesters, polyoxyethyleneether of sorbitaneesters, polyoxyethyleneether of sorbitolesters, polyethyleneglycol aliphatic acid esters, glycelol esters, sorbitane esters, propyleneglycol esters, sugar esters, fluoro $C_2$–$C_{10}$alkylcarboxylic acids, disodium N-perfluorooctanesulfonyl glutamate, sodium 3-(fluoro $C_6$–$C_{11}$alkyloxy)-1-$C_3$–$C_4$alkyl sulfonates, sodium 3-(ω-fluoro-$C_6$–$C_8$alkanoyl-N-ethylamino)-1-propane sufonates, N-[3-(perfluorooctanesulfonamide)-propyl]-N,N-dimethyl-N-carboxymethylene ammonium betaine, fluoro-$C_{11}$–$C_{20}$alkyl carboxylic acids, perfluoro $C_7$–$C_{13}$alkyl carboxylic acids, perfluorooctane sulfonic acid diethanolamide, Li, K and Na perfluoro $C_4$–$C_{12}$alkyl sulfonates, N-propyl-N-(2-hydroxyethyl)perfluorooctane sulfonamide, perfluoro $C_6$–$C_{10}$alkyl sulfonamide propyl trimethyl ammonium salts, potassium perfluoro $C_6$–$C_{10}$alkyl-N-ethylsulfonyl glycinates, bis-(N-perfluorooctylsulfonyl-N-ethylaminoethyl)phosphonate, mono-perfluoro $C_6$–$C_{16}$alkyl-ethyl phosphonates, perfluoroalkyl betaine. Since the acetylene glycols and acetylene alcohols belong to a nonionic type, the surfactant to be combinedly used is preferably selected from anionic or amphoteric ones in the case where the dye in the ink is a water-soluble acid dye or a direct dye.

The above surfactants make ink sufficiently permiate to an ink retaining layer.

The acetylene glycols or the acetylene alcohols of the present invention are represented by the general formulas (A), or (B):

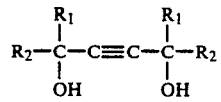

(A)

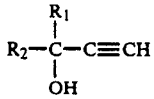

(B)

where $R_1$ is an alkyl group having 1–3 carbons, and $R_2$ is an alkyl group having 1–5 carbons.

Preferable compounds are shown below:

No. 1:

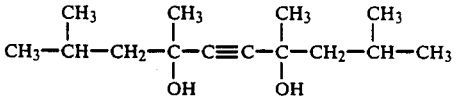

No. 2:

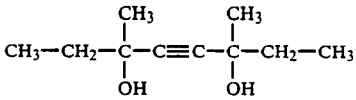

No. 3:

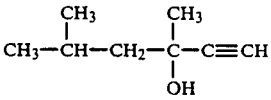

No. 4:

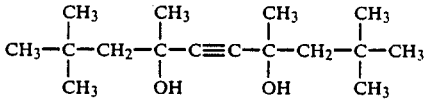

No. 5:

-continued

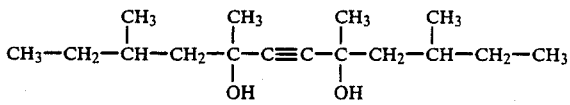

No: 6:

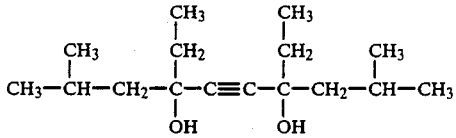

No. 7:

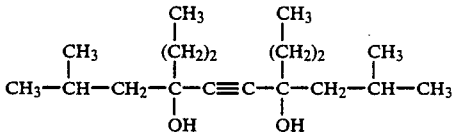

No. 8:

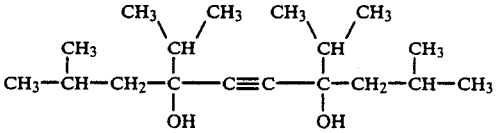

No. 9:

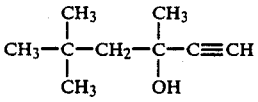

No. 10:

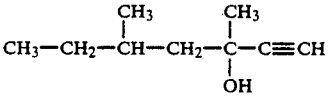

No. 11:

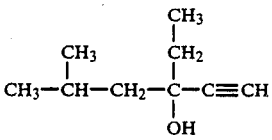

No. 12:

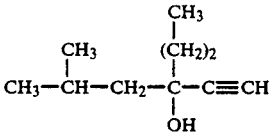

No. 13:

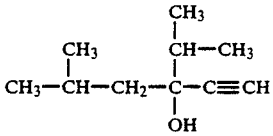

No. 14:

-continued

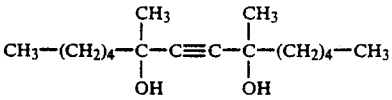

No. 15:

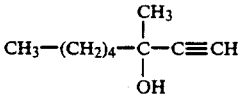

Such acetylene glycols and acetylene alcohols may be used singly or combinedly.

The mixing ratio of the surfactant to the acetylene glycol and/or acetylene alcohol is in the range of 1/1 to 20/1, preferably 2/1 to 10/1. The mixing ratio of 20/1 or less is undesirable because the occurrence of black stripes cannot be prevented, while the mixing ratio of 1/1 or more is also undesirable because the liquid transporting property of the ink transporting layer is impaired.

These additives are added to the ink transporting layer in an amount ranging from 0.1 to 20%, preferably from 0.2 to 10% based on the total weight of the ink transporting layer.

Various other additives such as a fluorescent dye, a coloring material, and a crosslinking agent may be added optionally in order to further improve the performance as the ink transporting layer in the present invention.

The thickness of the ink transporting layer is preferably in the range of from 5 to 150 μm, more preferably from 10 to 50 μm.

On the other hand, the ink retaining layer is required to have higher abosorbency for ink than that of the ink transporting layer in order to absorb and retain steadily the ink absorbed temporarily by the ink transporting layer. Therefore, the ink retaining layer should have high affinity to the recording agent as well as to the ink medium.

The reason is as follows. If the ink retaining layer has lower absorbency than the ink transporting layer, the ink will penetrate and diffuse excessively within the ink transporting layer along the interface with the ink retaining layer after the front of the ink has reached the ink retaining layer, because of undesired accumulation of the ink in the ink transporting layer, thus the resolution of the recorded image being lowered without formation of a high-quality recorded image.

The ink retaining layer is preferably non-porous and light-transmissive for the purpose of observing the image from the side opposite to the recording layer as mentioned above.

The ink retaining layers satisfying the above requirement are preferably constituted mainly of a light-transmissive resin capable of adsorbing the recording agent and/or a light transmissive resin soluble to the ink or capable of being swelled by the ink.

For an aqueous ink containing an acid dye or a direct dye as the recording agent, for example, the ink retaining layer is preferable be constituted of a resin exhibiting adsorptivity to the dyes such as a water-soluble or hydrophilic polymer capable of being swelled by an aqueous ink.

Such water soluble or hydrophilic polymers includes, for example, natural polymers such as albumin, gelatin, casein, starch, cationic starch, gum arabic, and sodium alginate; synthetic resins such as carboxymethylcellulose, hydroxyethylcellulose, polyamides, polyacrylamides, polyethyleneimines, polyvinylpyrrolidones, quaternized polyvinylpyrrolidones, polyvinylpyridinium halides, melamine resins, phenol resins, alkid resins, polyurethanes, acetal-modified polyvinyl alcohols, polyvinyl alcohols, ion-modified polyvinyl alcohols, polyesters, and polysodium acrylates; preferably the water-insolubilized hydrophilic polymers made by crosslinking the polymers thereof; hydrophilic and water-insoluble polymer complexes composed of two or more polymers; and hydrophilic and water-insoluble polymers having hydrophilic segments.

The ink retaining layer formed from the above material has preferably a thickness of from 1 to 30 μm, more preferably from 3 to 10 μm.

Any light-transmissive substrates may be used in the present invention. Specifically, resin films such as a polyester, and glass plates.

While the substrate in the present invention is preferably light-transmissive, the substrate may be opaque in the cases where the ink transporting layer is transparentized after completion of recording by heating, pressurizing or other means for observing the image from the recorded side.

The ink retaining layer and the ink transporting layer are formed on the substrate from the above exemplified materials by dissolving or dispersing the materials in a suitable solvent to prepare a coating solution and coating the solution on a substrate by roll-coating, rod-bar-coating, air-knife-coating, etc. and drying it rapidly. Otherwise the layer may be formed by hot melt coating of the above materials, or by preparing a separate sheet from the above materials and laminating it on a substrate.

In providing an ink retaining layer on a substrate, the adhesion between the layer and the substrate should preferably be fortified and any empty space therebetween be eliminated by formation of an anchor layer or other means.

Any space between the substrate and the ink retaining layer causes undesirably irregular reflection at the surface of the recorded image, thus lowering substantially the optical density of the image.

The image formation with the recording medium of the present invention is especially effective in recording with ink application of 10 nl/mm$^2$ or more and recording density of 300 dpi in full color.

As mentioned above, the present invention will give images with sharpness and resolution without causing a black stripe in full color recording where amount of ink applied per unit area is large and the recording density is 300 dpi or higher.

The examples below are intended to illustrate specifically the present invention. The percentages and the parts are based on weight.

EXAMPLE 1

A polyethylene terephthalate film (75 μm thick, trade name: Lumiror, made by Toray Industries, Inc.) was used as the substrate. The composition A shown below was applied on the substrate with a bar coater so as to give the dry film thickness of 5 μm, and dried at 140° C. for 5 minutes in a drying oven, forming an ink retaining layer.

Composition A

| | |
|---|---|
| Cation-modified polyvinyl alcohol (PVA-C318-2A, made by Kuraray Co., Ltd., 10% aqueous solution) | 100 parts |
| Blocked isocyanate (Elastoron BN-5, made by Daiichi kogyo Seiyaku Co., Ltd.) | 3 parts |
| Catalyst (Elastoron Catalyst 32, made by Daiichi Kogyo Seiyaku Co., Lte.) | Small amount |

Further, onto the ink retaining layer, the composition B shown below was applied with a bar coater so as to give the dry film thickness of 35 μm, and dried at 140° C. for 5 minutes in a drying oven to form an ink transporting layer, thus forming a recording medium of the present invention.

Composition B

| | |
|---|---|
| Urea-formalin resin powder (Organic filler made by Nippon Kasei K.K.) | 100 parts |
| Acetal-modified polyvinyl alcohol (10% solution in water/butylalcohol made by Sekisui Kagaku Kogyo Co., Ltd.) | 400 parts |
| Surfactant (Surflon S-131, solid content: 30%, made by Asahi Glass Co., Ltd.) | 1.4 parts |
| Acetylene glycol (Compound No.1 of this Specification) | 0.4 part |

Incidentally the amount of the added surfactant and the acetylene glycol corresponds to 0.58% of the total weight of the ink transporting layer.

On the above described recording medium, recording was conducted with a printer capable of giving a maximum ink application of 12 nl/mm$^2$ per unit area of the recording medium at two-color solid superposed printing and a recording density of 400 dpi.

The recording medium prepared thus was evaluated as below whether it meets the object of the present invention. The results are shown in Table 3.

1) Optical density (O.D.) of images printed in solid with black ink on the recording media was measured by means of a Macbeth optical densitometer RD-918 from the recording side a (the ink transporting layer side), and from the image observing side b (the substrate side).

2) Ink absorbency was evaluated by measuring the time elapsed before the ink comes not to stain a finger, by which the recorded portion is touched on a recorded material printed in solid in superposition with a yellow ink and a magenta ink left at a room temperature.

3) Sharpness of images was evaluated by observing, from the substrate side, a recorded matter in which a yellow ink and a magenta ink were applied to conduct printing in solid in superposition and a red band pattern was formed. The recording media were evaluated in three grades; those giving a clear edge of the image were evaluated as "A", those giving a significantly blurred edge were evaluated as "C", and those giving an intermediate state of the edge were evaluated as "B".

4) Resolution of the image was evaluated by observing the black band pattern formed by printing with inks of yellow, magenta, and cyan in solid in superposition in a similar manner as in the above item 3), and comparing with the printed image obtained in the item 3). The image giving the same breadth of the pattern with those of the item 3) was evaluated as "A", the image giving slightly different breadth of pattern was evaluated as "B", and the image giving the breadth of pattern significantly different from those of the item 3) was evaluated as "C".

5) Occurrence of black stripe was evaluated by continuously conducting printing with a yellow ink and a magenta ink in solid in superposition by use of the above-mentioned printer and observing the border portion between the lowermost portion of the preceeding printing and the uppermost portion of the subsequent printing. The occurrence of the black stripe was evaluated in three grades: significant occurrence of the black stripe was evaluated as "C", non-occurrence thereof was evaluated as "A", and the intermediate state was evaluated as "B".

6) Full color image evaluation was made by forming a practical image by use of an ink jet printer (Bubble jet printer BJC-440 made by Canon) and the printed matter was judged from overall visual evaluation regarding the image optical density, image sharpness, image resolution, and occurrence of black stripe. The satisfactory printing was evaluated as "A", unsatisfactory one as "C", and intermediate one as "B".

EXAMPLE 2

A recording medium was prepared by in the same manner as in Example 1 except that the acetylene glycol of Compound No. 2 was used in place of the acetylene glycol of Compound No. 1 used in Example 1. The evaluation results are shown in Table 3.

EXAMPLE 3

A recording medium was prepared by in the same manner as in Example 1 except that the acetylene alcohol of Compound No. 3 was used in place of the acetylene glycol of Compound No. 1 used in Example 1. The evaluation results are shown in Table 3.

EXAMPLES 4–10

Recording media were prepared by using the coating composition for ink transporting layers as shown in Table 1 in the same manner as in Example 1. The evaluation results are shown in Table 4.

TABLE 1

| | Example | | | | | | |
|---|---|---|---|---|---|---|---|
| | 4 | 5 | 6 | 7 | 8 | 9 | 10 |
| Urea-formalin resin powder (made by Nippon Kasei K.K.; organic filler) | 100 | 100 | 100 | 100 | 100 | 100 | 100 |
| Acetal-modified polyvinyl alcohol (10% solution in ethylcellosolve) | 400 | 400 | 400 | 400 | 400 | 400 | 400 |
| Surfactant (Surflon S-131, solid content: 30% made by Asahi Glass Co., Ltd.) | 0.311 | 0.622 | 6.22 | 31.1 | 62.2 | 4.7 | 8.889 |
| Acetylene Glycol (Compound No. 1) | 0.047 | 0.093 | 0.93 | 4.7 | 9.3 | 1.4 | 0.133 |

COMPARATIVE EXAMPLE 1

A recording medium was prepared in the same manner as in Example 1 except that the acetylene glycol No. 1 in the composition B was not used. The evaluation results are shown in Table 3.

COMPARATIVE EXAMPLE 2

A recording medium was prepared in the same manner as in Example 1 except that the surfactant was not used and the amount of acetylene glycol was 1.0 part in the composition B. The evaluation results are shown in Table 3.

COMPARATIVE EXAMPLE 3

A recording medium was prepared in the same manner as in Example 2 except that the surfactant was not used and the amount of acetylene glycol was 1.0 part. The evaluation results are shown in Table 3.

COMPARATIVE EXAMPLES 4–7

Recording media were prepared by using the coating composition for ink transporting layers as shown in Table 2 in the same manner as Example 1. The evaluation results are shown in Table 4.

TABLE 2

| | Comparative Example | | | |
|---|---|---|---|---|
| | 4 | 5 | 6 | 7 |
| Urea-formalin resin powder (made by Nippon Kasei K.K.; organic filler) | 100 | 100 | 100 | 100 |
| Acetal-modified polyvinyl alcohol (10% Water/butylalcohol solution made by Sekisui Kagaku Kogyo Co., Ltd.) | 400 | 400 | 400 | 400 |
| Surfactant (Surflon S-131, solid content: 30% made by Asahi Glass Co., Ltd.) | 0.153 | 77.8 | 3.11 | 8.974 |
| Acetylene glycol (Compound No. 1) | 0.023 | 11.7 | 1.87 | 0.108 |

TABLE 3

| | Example | | | Comparative example | | |
|---|---|---|---|---|---|---|
| | 1 | 2 | 3 | 1 | 2 | 3 |
| Image optical density a | 0.38 | 0.35 | 0.40 | 0.37 | 0.69 | 0.72 |
| Image optical density b | 1.50 | 1.56 | 1.47 | 1.55 | 0.58 | 0.46 |
| Ink absorbency | 3 sec | 2 sec | 3 sec | 3 sec | 30 sec | 30 sec |
| Image sharpness | A | A | A | A | C | C |
| Image resolution | A | A | A | B | C | C |
| Black stripe | A | A | A | C | C | C |
| Full color image evaluation | A | A | A | C | C | C |

TABLE 4

| | Example | | | | | | | Comparative example | | | |
|---|---|---|---|---|---|---|---|---|---|---|---|
| | 4 | 5 | 6 | 7 | 8 | 9 | 10 | 4 | 5 | 6 | 7 |
| Ratio of additives (surfactant and acetylene glycol) to ink transporting layer (% by weight) | 0.1 | 0.2 | 2.0 | 10.0 | 20.0 | 2.0 | 2.0 | 0.05 | 25.0 | 2.0 | 2.0 |
| Surfactant/acetylene glycol | 2/1 | 2/1 | 2/1 | 2/1 | 2/1 | 1/1 | 20/1 | 2/1 | 2/1 | 1/2 | 25/1 |
| Image optical density a | 0.50 | 0.40 | 0.32 | 0.30 | 0.30 | 0.35 | 0.33 | 0.65 | 0.28 | 0.41 | 0.41 |
| Image optical density b | 1.30 | 1.56 | 1.62 | 1.67 | 1.50 | 1.58 | 1.62 | 0.68 | 1.33 | 1.58 | 1.60 |
| Ink absorbency (seconds) | 7 | 3 | 2 | 2 | 2 | 2 | 2 | 10 | 2 | 3 | 2 |
| Image sharpness | A | A | A | A | A | A | A | A | C | B | B |
| Image resolution | A | A | A | A | A | A | A | A | C | A | B |
| Black stripe | A | A | A | A | A | A | A | A | C | A | B |
| Full color image evaluation | A | A | A | A | A | A | A | C | C | B | B |

I claim:

1. A recording medium having an ink retaining layer and an ink transporting layer provided on a substrate of a resin film or a glass plate, said ink transporting layer comprising a surfactant (A) and an acetylene glycol and/or an acetylene alcohol (B).

2. The recording medium of claim 1, wherein said surfactant (A) and said acetylene glycol and/or said acetylene alcohol (B) are contained in an amount of from 0.1 to 20% of the total weight of the ink transporting layer.

3. The recording medium of claim 1, wherein said surfactant (A) and said acetylene glycol and/or acetylene alcohol (B) are mixed in a ratio (A)/(B) ranging from 1/1 to 20/1.

4. The recording medium of claim 1, wherein said acetylene glycol is at least one compound selected from the group of the compounds represented by the general formula (I):

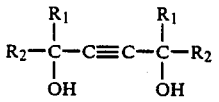

(I)

where $R_1$ is an alkyl group having 1-3 carbons, and $R_2$ is an alkyl group having 1-5 carbons.

5. The recording medium of claim 1, wherein said acetylene alcohol is at least one compound selected from the group of the compounds represented by the general formula (II):

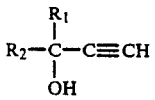

(II)

where $R_1$ is an alkyl group having 1-3 carbons, and $R_2$ is an alkyl group having 1-5 carbons.

6. The recording medium of claim 1, wherein said ink transporting layer is porous.

7. The recording medium of claim 1, wherein said ink retaining layer is nonporous.

8. The recording medium of claim 1, wherein said ink transporting layer is light-diffusive.

9. The recording medium of claim 1, wherein said ink retaining layer is light-transmissive.

10. The recording medium of claim 1, wherein said substrate is light-transmissive.

11. A printer matter having an image formed by a recording agent within an ink retaining layer in a recording medium, said recording medium comprising the ink retaining layer and an ink transporting layer provided on a substrate of a resin film or a glass plate, said ink transporting layer comprising a surfactant (A) and an acetylene glycol and/or an acetylene alcohol (B).

12. The printed matter of claim 11, wherein said surfactant (A) and said acetylene glycol and/or said acetylene alcohol (B) are contained in an amount of from 0.1 to 20% of the total weight of the ink transporting layer.

13. The printed matter of claim 11, wherein said surfactant (A) and said acetylene glycol and/or acetylene alcohol (B) are mixed in a ratio (A)/(B) ranging from 1/1 to 20/1.

14. The printer matter of claim 11, wherein said acetylene glycol is at least one compound selected from the group of the compounds represented by the general formula (I):

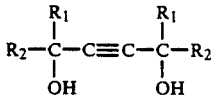

(I)

where $R_1$ is an alkyl group having 1-3 carbons, and $R_2$ is an alkyl group having 1-5 carbons.

15. The printed matter of claim 11, wherein said acetylene alcohol is at least one compound selected from the group of the compounds represented by the general formula (II):

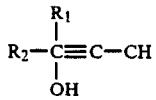

(II)

where $R_1$ is an alkyl group having 1-3 carbons, and $R_2$ is an alkyl group having 1-5 carbons.

16. The printed matter of claim 11, wherein said ink transporting layer is porous.

17. The printed matter of claim 11, wherein said ink retaining layer is nonporous.

18. The printed matter of claim 11, wherein said ink transporting layer is light-diffusive.

19. The printed matter of claim 11, wherein said ink retaining layer is light-transmissive.

20. The printed matter of claim 11, wherein said substrate is light-transmissive.

21. A process for forming an image comprising the step of applying droplets of an ink on a recording medium, said recording medium comprising an ink retaining layer and an ink transporting layer provided on a substrate of a resin film or a glass plate, said ink transporting layer comprising a surfactant (A) and an acetylene glycol and/or an acetylene alcohol (B).

22. The process for forming an image of claim 21, wherein said surfactant (A) and said acetylene glycol and/or said acetylene alcohol (B) are contained in an amount of from 0.1 to 20% of the total weight of the ink transporting layer.

23. The process for forming an image of claim 21, wherein said surfactant (A) and said acetylene glycol and/or said acetylene alcohol (B) are mixed in a ratio (A)/(B) ranging from 1/1 to 20/1.

24. The process for forming an image of claim 21, wherein said acetylene glycol is at least one compound selected from the group of the compounds represented by the general formula (I):

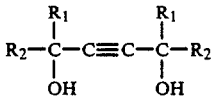

(I)

where $R_1$ is an alkyl group having 1–3 carbons, and $R_2$ is an alkyl group having 1–5 carbons.

25. The process for forming an image of claim 21, wherein said acetylene glycol is at least one compound selected from the group of the compounds represented by the general formula (II):

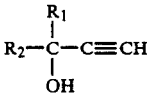

(II)

where $R_1$ is an alkyl group having 1–3 carbons, and $R_2$ is an alkyl group having 1–5 carbons.

26. The process for forming an image of claim 21, wherein said ink transporting layer is porous.

27. The process for forming an image of claim 21, wherein said ink retaining layer is nonporous.

28. The process for forming an image of claim 21, wherein said ink transporting layer is light-diffusive.

29. The process for forming an image of claim 21, wherein said ink retaining layer is light-transmissive.

30. The process for forming an image of claim 21, wherein said substrate is light-transmissive.

31. The process for forming an image of claim 21, wherein the image is formed using yellow, magenta, cyan and black inks.

32. The process for forming an image of claim 21, wherein droplets of an ink are applied on the ink transporting layer side of the recording medium.

* * * * *

UNITED STATES PATENT AND TRADEMARK OFFICE

CERTIFICATE OF CORRECTION

PATENT NO. : 5,059,983

DATED : October 22, 1991

INVENTOR(S) : Masahiko Higuma et al.

It is certified that error appears in the above-identified patent and that said Letters Patent is hereby corrected as shown below:

COLUMN 2:

Line 61, "Accordingly" should read --Accordingly,--.

COLUMN 3:

Line 17, "preferable" should read --preferably--;

Line 23, "polyacrylates" should read --polyacrylates,--; and

Line 42, "gum arabia" should read --gum arabic--.

COLUMN 4:

Line 7, "sufon-" should read -- sulfon- --.

COLUMN 6:

Line 36, "abosorbency" should read --absorbency--;

Line 63, "preferable be" should read --preferably--; and

Line 67, "includes," should read --include,--.

UNITED STATES PATENT AND TRADEMARK OFFICE

CERTIFICATE OF CORRECTION

PATENT NO. : 5,059,983 Page 2 of 2

DATED : October 22, 1991

INVENTOR(S) : Masahiko Higuma et al.

It is certified that error appears in the above-identified patent and that said Letters Patent is hereby corrected as shown below:

COLUMN 7:

Line 6, "alkid" should read --alkyd--.

COLUMN 8:

Line 32, "Incidentally" should read --Incidentally,--.

COLUMN 11:

Line 22, "I Claim:" should read --What is claimed is:--.

Signed and Sealed this

Sixth Day of April, 1993

*Attest:*

STEPHEN G. KUNIN

*Attesting Officer*

*Acting Commissioner of Patents and Trademarks*